US008985635B2

(12) United States Patent
Hurley

(10) Patent No.: US 8,985,635 B2
(45) Date of Patent: Mar. 24, 2015

(54) AC CONDENSATE DRAIN LINE EVACUATION ADAPTER

(76) Inventor: Mark Hurley, Boynton Beach, FL (US)

( * ) Notice: Subject to any disclaimer, the term of this patent is extended or adjusted under 35 U.S.C. 154(b) by 0 days.

(21) Appl. No.: 13/598,186

(22) Filed: Aug. 29, 2012

(65) Prior Publication Data

US 2014/0062077 A1 Mar. 6, 2014

Related U.S. Application Data

(60) Provisional application No. 61/575,787, filed on Aug. 29, 2011.

(51) Int. Cl.
*F16L 43/00* (2006.01)

(52) U.S. Cl.
USPC ..... 285/179; 285/93

(58) Field of Classification Search
USPC ..... 285/148.23, 7, 148.24, 123.3, 93, 179
See application file for complete search history.

(56) References Cited

U.S. PATENT DOCUMENTS

| | | | | |
|---|---|---|---|---|
| 2,697,842 | A | 12/1954 | Meyer | |
| 3,670,726 | A * | 6/1972 | Mahon et al. | 128/204.18 |
| 5,530,988 | A | 7/1996 | McQuillan | |
| 5,722,458 | A | 3/1998 | Potter | |
| 5,813,702 | A * | 9/1998 | McGuire | 285/148.23 |
| 5,964,238 | A | 10/1999 | Junkin | |
| 6,041,611 | A | 3/2000 | Palmer | |
| 6,164,337 | A * | 12/2000 | Weise et al. | 138/44 |
| 6,427,458 | B1 | 8/2002 | Fowler | |
| 6,608,023 | B2 | 8/2003 | Klaers et al. | |
| 8,113,543 | B1 * | 2/2012 | Romani et al. | 285/7 |
| 8,156,956 | B1 | 4/2012 | Coogle | |
| 2006/0042292 | A1 | 3/2006 | Kimbrough et al. | |
| 2011/0061745 | A1 | 3/2011 | Pearson | |

* cited by examiner

*Primary Examiner* — Aaron Dunwoody
(74) *Attorney, Agent, or Firm* — McHale & Slavin, P.A.

(57) ABSTRACT

An air conditioner condensate drain line evacuation adapter formed from a housing member having an end wall constructed and arranged for securement to various sized suction hoses used on conventional wet vacuums. A second end of the housing member is securable to the discharge end of a condensate drain located on the exterior of a building. Portions of the housing member can include transparent sections to permit a visual of the fluid evacuation.

5 Claims, 3 Drawing Sheets

AC CONDENSATE DRAIN LINE EVACUATION ADAPTER

PRIORITY CLAIM

This invention is based upon and claims the priority date of Provisional Patent Application Ser. No. 61/575,787 filed Aug. 29, 2011 entitled "AIR CONDITIONER CONDENSATE DRAIN LINE VACUUM CLEANER ATTACHMENT HOSE," the contents of which are incorporated herein by reference.

FIELD OF THE INVENTION

This invention relates to the field of HVAC equipment and in particular to an evacuation adapter for purging AC condensate drain lines with a vacuum.

BACKGROUND OF THE INVENTION

Residential and commercial air conditioner systems utilize drain lines for the removal of condensation created by the air conditioner evaporator coil. Over time, drain lines can become clogged due to algae, fungus or other debris. For this reason, a condensate catch pan is placed beneath the evaporator coil to collect condensate, should the drain line become clogged. Excess condensate is held in the catch pan for emergency only and the drain pan will hopefully have a safety float switch that will stop the air conditioner. Once the air conditioner is stopped, the condensate flow is stopped thereby preventing overflow of the catch pan. Also, once the air conditioner is stopped, the occupier of the premise will realize that a problem has arisen and a full catch pan becomes a visual indicator the drain line is clogged.

In commercial applications the condensers can be mounted above the workspace wherein a catch pan overflow can result in tremendous damage to the workspace. Equally as damaging is when a leak left unattended can ruin carpets, furniture, wall board and lead to mold conditions. The growth of algae is highest during warm weather conditions which coincide with the highest air conditioner use. Unfortunately HVAC service people are the busiest during the warm weather reducing the possibility of a timely service call which can aggravate an already unpleasant experience.

A clogged drain line can be cleared by flushing pressurized water or air through the drain line to remove the clog. A low pressure flush may be inadequate, while a high pressure flush may rupture the drain lines. Either technique must be properly performed or risk damaging of the pipe, which can lead to further problems. For instance, if pressurized water is used to clear the drain line then care must be taken to assure the drain line is not over-pressurized wherein pressurized water is spilled within the premises. If pressurized air is use, a drain pipe could be split leading to slow leakage that may be undetected until later use.

Condensate drain lines are commonly constructed of PVC plastic. PVC, especially thin wall schedule 40, operates well in a no pressure situation such as that occurring in a gravity feed drain line and is capable of handling prolonged pressure and associated pressure spikes, within reason. The problem with PVC pipe is that when improperly installed, a failure can be hidden behind a wall or ceiling and it will not give a warning before failure. The PVC piping is coupled together by use of glue which, if installed improperly, can leak the very first time pressurized water or air is introduced.

The industry includes a number of devices that are used for purging clogged drain lines. The prior art includes devices having complex structures which are typically employed to unclog the drain lines by pressurization. For instance, U.S. Pat. No. 6,427,458 discloses the use of a pump with check valves attached to one end of a drain line which drains condensate from an air handler. A handle on the pump is used to create respectively a vacuum or pressure within the pump which is communicated to the drain line. When sufficient vacuum or pressure is created, it will dislodge a blockage in the drain line allowing the drain line to naturally drain. A valve is placed at one end of the pump which allows accumulated liquid in a collection pan to be pumped from the collection pan in the process of clearing condensate from the air handler.

U.S. Publication No. 2011/0061745 discloses an automated condensate drain line cleaning apparatus. The fluid flow regulation device may be electrically coupled with the controller to receive at least one control signal from the controller. The fluid flow regulation device may cause a fluid to flow into a condensate drain line through the fluid supply line responsive to at least one control signal.

U.S. Pat. No. 5,530,988 discloses a device for unclogging pipes or other lines. The device includes a canister adapted to receive a pressurized gas, the canister having at a first end a first valve adapted to be coupled to the pipe or line that is to be unclogged. The canister has at a second end a closure element, the closure element having a second valve attached thereto, the second valve adapted to connect to a source of pressurized gas. The canister further has a pressure gauge coupled thereto for indicating the pressure in the canister. The pressurized gas is fed into the canister through the second valve, and pressurized gas in the canister is fed to the pipe or line to be unclogged by means of the first valve. A method and device for providing an additive, such as a cleaning product, to a tank or line is also disclosed.

U.S. Pat. No. 6,041,611 discloses a manifold operatively placed in fluid communication with the condensate drain line. A water stream, which is operatively connected with the first line, is provided so that the water stream may be channeled through the manifold and into the condensate drain line.

U.S. Publication No. 2006/0042292 discloses a method of removing microbial and bacterial growth inside a blocked HVAC condensate drain line using compressed air without cutting into or disassembling the drain line.

U.S. Pat. No. 8,156,956 discloses an assembly that mounts between the drain pan and the drain line. A shut off valve shuts off the passage to the pan while maintenance is performed. Male members may have different terminations at a second end, including a barbed tube for resilient tubing, a compressed air tire valve for delivering gas, a compressed nitrogen coupling, a tapered funnel for the nozzle of a vacuum/blower, and a water sensor.

Several devices have proposed placing special valves in a drain line to facilitate the clearing of air conditioning drain lines. Potter, U.S. Pat. No. 6,608,023; Palmer, U.S. Pat. No. 6,041,611; Junkin, U.S. Pat. No. 5,964,238; and, Potter, U.S. Pat. No. 5,722,458 all propose placement of valves in a drain line to allow introduction of either suction or air pressure or a hydraulic pressure to clear a drain line.

More generally, a variety of different types of pumps that induce either a pressure or suction into a drain system are proposed for cleaning of drain lines. For example, Meyer, U.S. Pat. No. 2,697,842, proposes a combination hand and air force pressure pump and plunger for use generally in the same fashion as a standard plunger or plumber's helper. U.S. Pat. No. 6,427,458 discloses a device to clear a blockage from a drain line. A pump with check valves attaches to one end of a drain line which drains condensate from an air handler for an air conditioner or heat pump. A handle on the pump is used to create respectively a vacuum or pressure within the pump which is communicated to the drain line. A valve is placed at one end of the pump which allows accumulated liquid in a collection pan to be pumped from the collection pan in the process of clearing condensate from the air handler.

What is lacking in the art is an AC condensate drain line evacuation adapter that allows attachment to a conventional vacuum system for use in purging the condensate drain line of fluid and debris.

SUMMARY OF THE INVENTION

The present invention is a condensate drain line evacuation adapter that attaches to discharge end of a condensate line on the outside of a building. The adapter is based upon a housing member having a first end constructed and arranged for releasable securement to a various sized suction hoses found on a conventional wet vacuum. A second end of the adapter includes a 90 degree angled attachment for releasable securement to a discharge end of the condensate drain line. The wet vacuum is used to draw fluid and debris from the condensate drain line for purposes of declogging the condensate drain line. This allows for removal of the clog from outside the building.

An objective of the invention is to provide an inexpensive and reliable device for purging condensate drain lines without pressurization.

Yet still another objective of the invention is to provide a multi-sized adapter that allows condensate lines to be purged without the need of professional HVAC personnel.

Still another objective of the invention is to provide a device that couples to a conventional wet vacuum for drawing debris through the drain line.

Still another objective of the invention is to provide a device for draining condensate lines which does not rely upon pressurization to eliminate risk of further water damage to the premises, or rupture to the drain lines.

Yet still another objective of the invention is to provide a device that allows the use of various wet vacuum attachments.

Yet another objective of the invention is to provide a device that allows for the adaptation to the three conventional sized hoses, namely 2.5", 1⅞" and 1¼" flexible ribbed hoses including the wet vacuum attachments that are placed on the end of the hoses.

Still another objective of the invention is to provide a device that allows a repair man to clean the condensate drain lines without ever entering the premises. This allows the condensate line to be cleared while the premises are vacant, or in instances where the homeowner does not want a repair man to enter the home, e.g. baby sitter, elderly, handicapped, and so forth.

Other objectives and advantages of this invention will become apparent from the following description taken in conjunction with the accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

Figure 1:
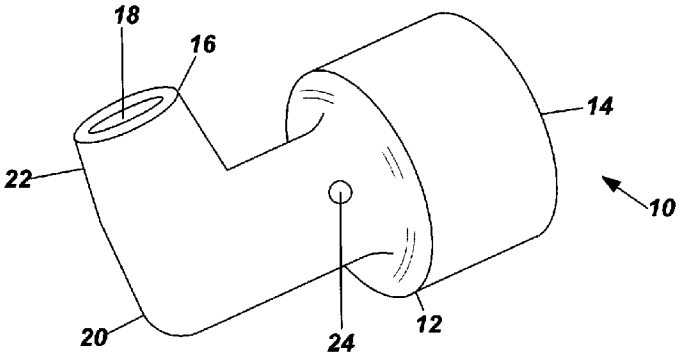
FIG. 1 is a front perspective view of the evacuate adapter of the instant invention.

Now referring to FIG. 1 set forth is a condensate drain line evacuation adapter 10 of the instant invention comprising a housing member 12 defined by a first end 14 which is sized for securement to the end of a suction hose used on a conventional wet vacuum. The housing member 12 is further defined by a second end 16 which is positioned at approximately a 90 degree angle to the first end 14. Between the first end 14 and the second end 16 is an internal fluid pathway 18 that is at least ½" diameter along the length of the fluid pathway 18. The second end 16 can be in the form of an elbow 20 to provide the bend necessary for use in attachment to the end of a condensate drain line placed along an outer side wall of a structure.

The second end 16 can be tapered to allow adaptation to most any size drain line. Alternatively, the second end 16 can consist of a short piece of ½" pipe to accommodate a majority of the residential condensate drain lines or ¾" pipe to accommodate a majority of the commercial condensate drain lines. If a ¾" drain pipe exists, a ½" pipe for the second end 16 can be placed within the drain pipe. If a ½" drain pipe exists and a ½" pipe is used for the second end 16, a female to female union can be used to temporarily couple the pipes.

Figure 2:
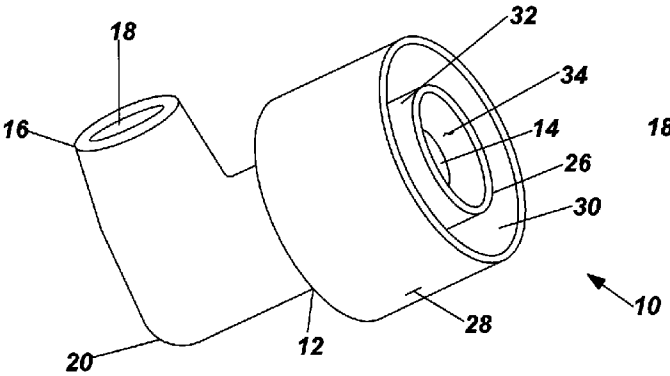
FIG. 2 is a rear perspective view of the adapter.

The housing member 10 is preferable constructed of a single piece of plastic with sections that may be made of a transparent material so as to allow visual indication of fluid flow. As shown in FIG. 1, sight glass 24 is used to allow visual inspection of fluid flow in an otherwise opaque housing member 12 allowing the operator to visually determine if fluid is flowing through the housing member 12. Referring to FIG. 2 shown as a housing member 10 with the first end 14 wherein the housing member 12 is shown in conjunction with a second circular side wall 26. The housing member 12, also referred to as the first circular side wall, is constructed and arranged to attach to a vacuum hose that can be placed along either the outer surface 28 or the inner surface 30. This attachment allows for two different sizes of commonly known vacuum hoses whether they are metric or English. Similarly second circular side wall 26 has an outer surface 32 and inner surface 34 allowing yet attachment to another size of vacuum hose along either the outer surface 32 or the inner surface 34.

The fluid pathway 18 between first end 14 and second end 16 is centrally disposed wherein the attachment of a vacuum hose to surfaces 28, 30, 32 or 34 allows uninhibited fluid draw through the fluid pathway 18. A wet vacuum is then used to draw fluid and debris from the condensate drain line for purpose of de-clogging the condensate drain line. The use of a vacuum, versus pressurized air or water, eliminates the possibility of over pressurization of the condensate drain line wherein improper installations would not be expounded upon by drawing a vacuum.

Figure 3:
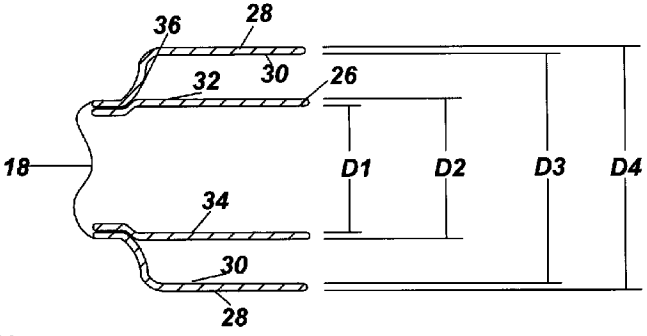
FIG. 3 is a cross sectional side view of the adapter.

Referring to FIG. 3 illustrated is housing member 12 wherein the outer surface 28 is defined by diameter D4 to be about 2½" where in a vacuum hose having an inner diameter of 2½" slides along the outer surface 28 for frictional engagement thereto. It should be noted that a perfect seal is not necessary as leakage is drawn inward by the use of a vacuum.

However, the tighter the seal the better the vacuum pull wherein the tilting or angling of the vacuum hose results in a better seal with the outer surface. Similarly inner surface 30, having a diameter D3 of about 2¼" allows for attachment of a vacuum hose having an outer diameter of about 2¼". A flexible hose can be pushed into the housing to frictionally form a seal with inner surface 30. If non conventional size or shaped vacuum hoses are employed, the end of the vacuum hose can be pressed against the back of the end wall 36 wherein the end wall 36 operates to seal against the leading edge of the vacuum hose.

Similarly the second circular side wall has an outer surface 32 having a diameter D2 of about 1⅞" wherein a vacuum hose having an inner diameter of about 1⅞" can be slid over the outer surface 32 so as to provide suction through fluid pathway 18. The second circular side wall further includes an inner surface 34 having a diameter D1 of about 1¼" capable of sealing against a wet vacuum hose having an outer diameter of about 1¼". The range of the evacuation adapter 10 allows for attachment of hoses from 1¼" through 2½". As previously stated any size in between that does not provide a seal can be pressed against end wall 36. Further, the side walls and endwall can include a coating or deformable material that allows for sealing of the end tube. If the vacuum hose employs an odd size hose diameter or end fitting, the second circular side wall acts as an alignment guide so that the end of the vacuum hose cannot clog the flow through fluid pathway 18.

Figure 4:
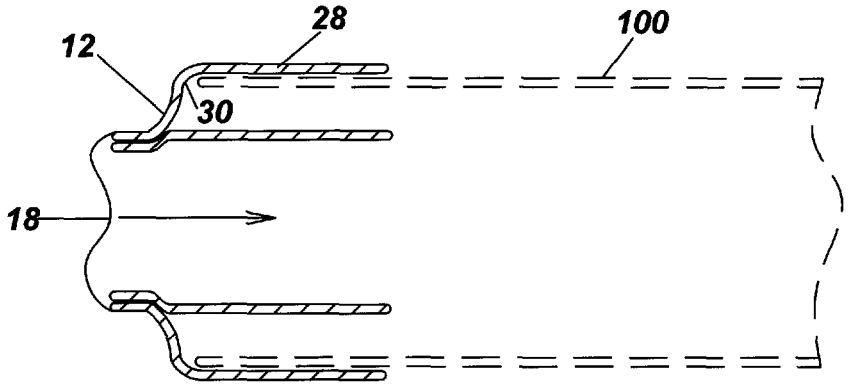
FIG. 4 is a cross sectional side view depicting a 2¼" diameter vacuum hose.
Figure 5:
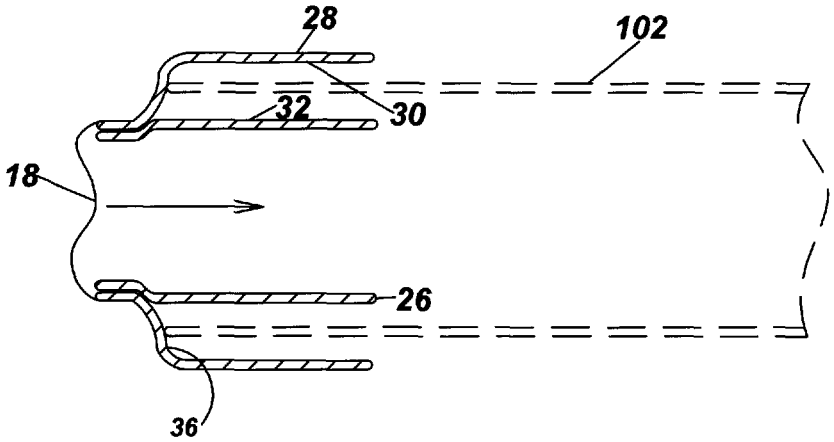
FIG. 5 is a cross sectional view depicting a 1⅞" diameter vacuum hose.
Figure 6:
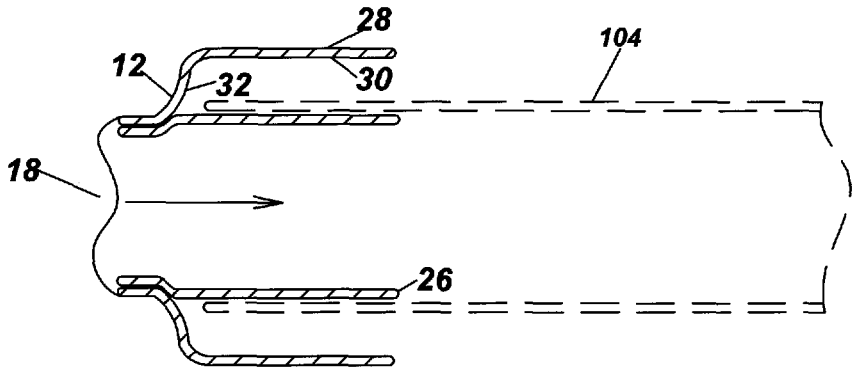
FIG. 6 is a cross sectional side view depicting a 1¼" diameter vacuum holder.

By way of illustration FIG. 4 depicts the housing member 12 having outer surface 28 and inner surface 30. The flexible vacuum hose 100 depicted frictionally engages the inner surface 30 wherein the fluid pathway 18 allows suction directly within the hose. FIG. 5 depicts the housing member 12 having inner surface 30 and outer surface 32 on the second circular end wall 26. In this embodiment the flexible vacuum hose 102 engages end wall 36 and fluid pathway 18 is uninhibited. It should be noted that the second circular side wall 26 operates to prevent the hose 102 from impeding upon the fluid pathway 18 and can be simply held against the end wall 36 for a period of time for the suction to take place for evacuation of the condensate line. FIG. 6 is another illustration depicting a housing member 12 with the second circular side wall 26 having an outer surface 32 wherein flexible hose 104 engages the outer surface so as to provide a seal in allowing ease of condensate flow in the fluid pathway 18.

Figure 7:
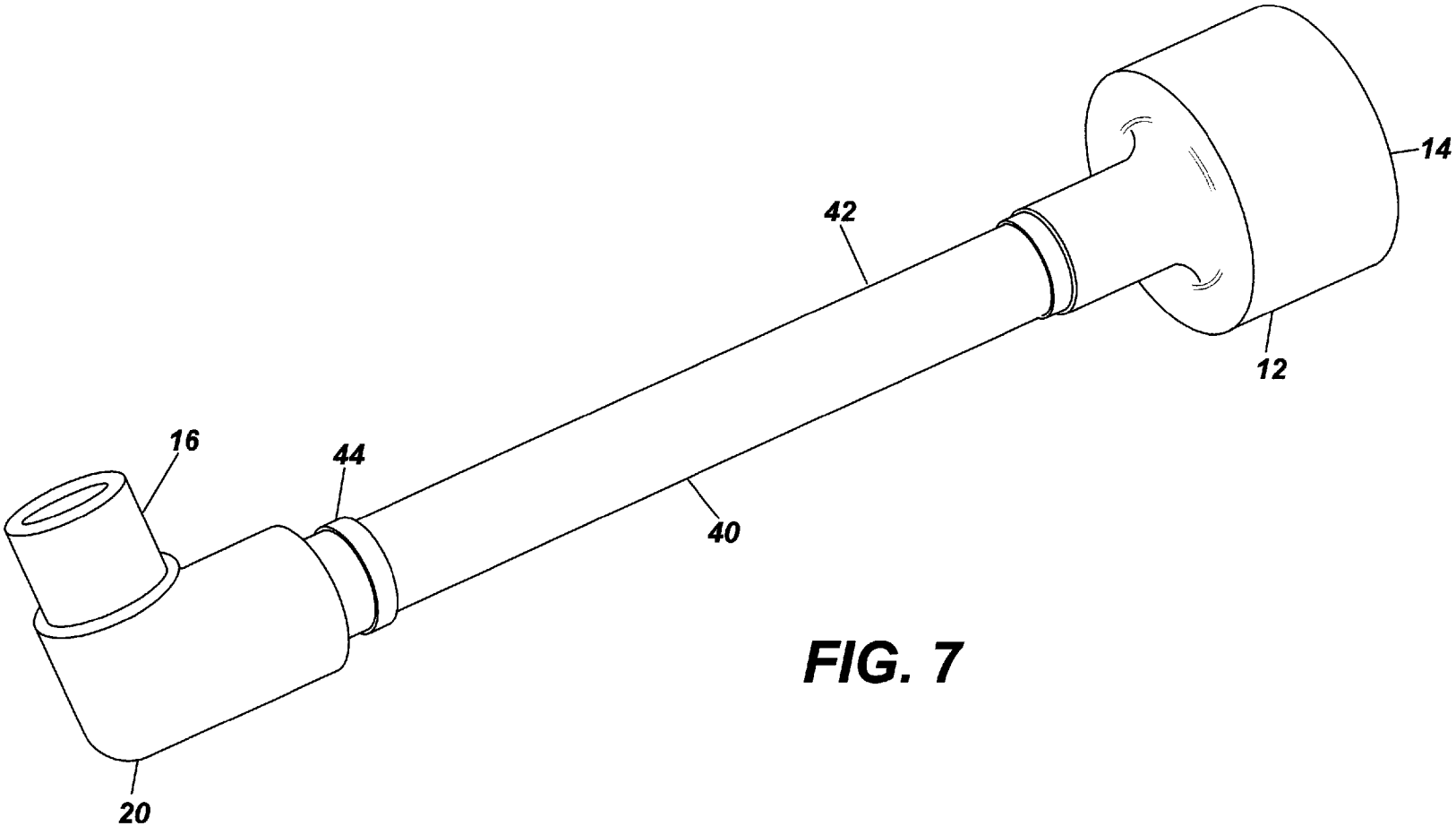
FIG. 7 is a perspective view of the evacuation adapter with an extension tube.

Now referring to FIG. 7 set forth is another embodiment of the invention wherein the housing member 12 is spaced apart from the second end 16 by tubing member 40. The tubing member 40 can be made of a flexible material allowing bendability between the first end 14 and the second end 16. Tubing member 40 may be made of a transparent or translucent material allowing visualization of flow through the tubing as it passes from the second end 16 into the evacuation adaptor 10 connected to the wet vacuum along first end 14. As an alternative elbow 20 maybe made of a clear material while the tubing 40 and first end 14 can be made of an opaque material. In this embodiment the reducing from the wet vacuum housing member 12 shown by use of a reducer 42 for coupling to the tubing member 40 which is previously mentioned may be made of PVC or a flexible rubberized plastic allowing ease of flexibility.

The housing member 12 of the instant invention can be made of a single piece of plastic through conventional molding techniques or be made of multiple parts all of which are designed to have a first end 14 for securement to a vacuum hose pipe and a second end 16 in securement to a condensate drain line. The purpose of the wet vacuum, not shown, is for use in drawing fluid from the condensate drain line for the purpose of de-clogging. The reduction in size between the first end 14 and the second end 16 to ½" can create a flow reduction to help facilitate clog removal.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An air conditioner condensate drain line evacuation adapter for use in combination with a conventional wet vacuum comprising: a housing member formed from a first cylindrical shaped wall having an inner wall surface and an outer wall surface, said outer wall surface having a first diameter forming a first end section which transitions to a second diameter forming a second end section; a second cylindrical shaped wall positioned within said first end section having an inner surface and an outer surface forming a third diameter, said first diameter is greater than said second diameter, said third diameter is less than said first diameter and greater than said second diameter; and an internal fluid pathway extending through said housing member formed by an inner surface of said second section of said first cylindrical shaped wall and said inner surface of said second cylindrical shaped wall; whereas said second end section is releasably securable to an air conditioner condensate drain line and either said outer wall surface or said inner wall surface of said first cylindrical shaped wall in said first end section, or said outer surface or said inner surface of said second cylindrical shaped wall is releasably securable to said wet vacuum whereby the wet vacuum can be used for evacuation of the air conditioner condensate drain line, wherein said second section of said first cylindrical shaped wall includes a sight glass to allow visual inspection of fluid flow.

2. The condensate drain line evacuation adapter according to claim 1 wherein said first cylindrical shaped wall is constructed of an opaque material.

3. The condensate drain line evacuation adapter according to claim 1 wherein said second section forms a 90 degree elbow.

4. The condensate drain line evacuation adapter according to claim 3 wherein said elbow is constructed of a transparent plastic material.

5. The condensate drain line evacuation adapter according to claim 1 wherein said internal fluid pathway is about ¾".

* * * * *